United States Patent [19]

Sindlinger et al.

[11] 4,105,392

[45] Aug. 8, 1978

[54] PHOTOFLASH LAMP

[75] Inventors: Ronald E. Sindlinger, Muncy; Emery G. Audesse, Williamsport, both of Pa.

[73] Assignee: GTE Sylvania Incorporated, Stamford, Conn.

[21] Appl. No.: 797,890

[22] Filed: May 17, 1977

Related U.S. Application Data

[63] Continuation of Ser. No. 633,743, Nov. 20, 1975, abandoned.

[51] Int. Cl.[2] ..... F21K 5/02

[52] U.S. Cl. ..... 431/95 R

[58] Field of Search ..... 431/94, 95, 95 A

[56] References Cited

U.S. PATENT DOCUMENTS

| | | | |
|---|---|---|---|
| 3,872,560 | 3/1975 | Bock | 431/95 R X |
| 3,873,260 | 3/1975 | Cote | 431/95 |
| 3,873,261 | 3/1975 | Cote | 431/95 |
| 3,884,615 | 5/1975 | Sobieski | 431/95 R |
| 4,039,273 | 8/1977 | Cote | 431/95 |

*Primary Examiner*—Carroll B. Dority, Jr.
*Attorney, Agent, or Firm*—Edward J. Coleman

[57] ABSTRACT

A high-voltage type photoflash lamp filled with a filamentary combustible material and oxygen and having an ignition structure comprising a pair of spaced apart lead-in wires bridged at their inner ends by a mass of primer material. An insulating sleeve encloses one of the wires, with the end of that wire extending beyond the open end of the sleeve. Formed at an angle from the other lead-in wire is a terminating portion which overlies and is spaced from the open end of the sleeve to provide a predetermined gap between the terminating portion and the end of the sleeved wire. The primer material is disposed to cover the open end of the sleeve and bridge the gap.

6 Claims, 4 Drawing Figures

PHOTOFLASH LAMP

This is a continuation of application Ser. No. 633,743, filed Nov. 20, 1975, now abandoned.

BACKGROUND OF THE INVENTION

This invention relates to photoflash lamps and, more particularly, to flashlamps of the type containing a primer bridge ignited by a high voltage pulse.

High voltage flashlamps may be divided historically into three categories: (1) those having a spark gap within the lamp such that electrical breakdown of a gaseous dielectric (e.g., the combustion-supporting oxygen atmosphere) is an integral part of the lamp ignition mechanism; (2) those having a conductive primer bridge that electrically completes the circuit between the lead-in wires; such primers are rendered conductive by additives such as acetylene black, lead dioxide, or other electrical conduction-promoting agents; and (3) lamps having an essentially nonconducting primer bridge that connects the inner ends of the lead-in wires and which becomes conductive, upon application of a high voltage pulse, by means of breakdown of the dielectric binder separating conductive particles therein.

The earliest high voltage flashlamps were of the spark gap type construction wherein an electrical spark would pass through the gaseous atmosphere within the lamp. The spark would jump between two electrodes, at least one of which was coated with a primer composition. Such lamps tend to exhibit poor sensitivity and reliability when flashed from low power sources such as the miniaturized piezoelectric devices that are suited for incorporating into pocket-sized cameras. Most of the electrical input energy in such lamps is lost to the gas atmosphere by the spark. Also, the electrical characteristics vary considerably from one lamp to another because of shreds of metallic combustible in the spark gap and consequent variations in effective gap length.

The use of spaced lead-in wires interconnected by a quantity of electrically conductive primer gives rise to highly predictable behavior and a well-defined electrical path through the lamp. Here again, however, relatively high-powered flash sources must be used in order to attain reliable lamp flashing.

Present state of the art flashlamps of the high-voltage type make use of a bridge of initially nonconducting primer to interconnect the inner ends of the lead-in wires. Considerably higher sensitivity is attainable by this method, apparently because the breakdown and discharge follow a discrete path through the primer composition and thereby promote greater localized heating. With respect to specific construction, such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion-supporting gas, such as oxygen, at an initial fill pressure of several atmosphere.

Lamp functioning is initiated by application of a high voltage pulse (e.g., several hundred to several thousand volts, as, for example, from a piezoelectric crystal) across the lamp lead-in wires. The mass of primer within the lamp then breaks down electrically and ignites; its deflagration, in turn, ignites the shredded combustible which burns antinically.

The fabrication and testing of a number of different ignition structures has shown several problem areas that are peculiar to high voltage type flashlamps, and which are familiar to those skilled in the art of flashlamp design. For example, random location of the shreds of metallic combustible can cause short circuiting of the lead-in wires or interfere with the intended electrical breakdown path through the primer. Post-flash short circuiting can be caused by primer residue, metallic or semimetallic droplets of slag from the ignited shreds of combustible, and possible welding of the lead-in wires after ignition.

An example of a prior art lamp structure directed to overcoming some of those problems is described in U.S. Pat. No. 3,863,260 of Coté, wherein one of the lead-in wires of the ignition mount is recessed in a glass insulating sleeve which is sealed to the press at one end and open at the other end. The other lead-in wire is formed so that it rests against and terminates slightly above the open end of the sleeve. The mass of primer material is disposed to cover the open end of the sleeve and bridge the ends of the lead-in wires. The glass sleeve has a side vent opening for the purpose of avoiding air entrapment during primer application to assure the primer material reaches the sleeved lead. Such a vent hole, however, introduces a degree of added cost and exposes the sleeved lead-in wire to a possible shred shorting condition. Consequently, an alternative approach that has been employed is to use a continuous sleeve, with no vent hole. But this last-mentioned mount design also has some apparent shortcomings. The fact that the sleeved lead-in wire is recessed causes problems with primer bridging. It is necessary to use air pressure to force primer into the glass sleeve to contact the lead. This method consists of a seal connecting the top edge of the primered bottles and using the same seal as a means to force primer into the sleeve. Poor sealing of the bottle caused by a slight chip in the glass, worn or torn sealing edge, etc., can cause splashed primer and primer not contacting the lead in the sleeve. Another criticism of the prior construction is the possibility of shreds getting into the sleeve opening. Since the primer is being forced into the sleeve, an opening can appear in the primer, enhancing the possibilities of shred shorts. A third possible problem deals with voltage breakdown. The distance between the inner leads cannot be decreased because of the nature of the construction. A higher breakdown voltage will result from the wider span between the leads.

SUMMARY OF THE INVENTION

In view of the foregoing, it is an object of this invention to provide an improved photoflash lamp with a more reliable ignition means.

Another object is to provide improved control of the primer quantity applied and to ensure a complete primer bridge for the ignition structure of high-voltage type flashlamps.

Another object is to provide improved protection against shred shorting through to the lead in the glass insulating sleeve of the ignition structure.

Yet another object is to provide an improved ignition structure for high-voltage type flashlamps which exhibits a lower primer ignition breakdown voltage than heretofore.

A further object is to provide an ignition structure which assures more positive shred ignition by the primer.

These and other objects, advantages and features are attained, in accordance with the principles of this invention by extending the sleeved lead-in wire beyond the sleeve opening and forming the other lead-in wire to have a terminating portion at an angle thereto which overlies and is spaced from the open end of the sleeve to provide a predetermined gap between the terminating portion and the end of the sleeved lead-in wire. The mass of primer material is then applied so as to cover the open end of the sleeve and bridge the above-mentioned gap. This structure provides a definite primer bridge between the inner portions of the lead-in wires. The sleeved lead-in wire is better protected from shred shorts. Improved control of the primer quantity and voltage breakdown is provided by using a specified gap between the sleeved lead-in wire and the free lead-in wire resting above the sleeve. The structure also assures more positive shred ignition by the primer.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
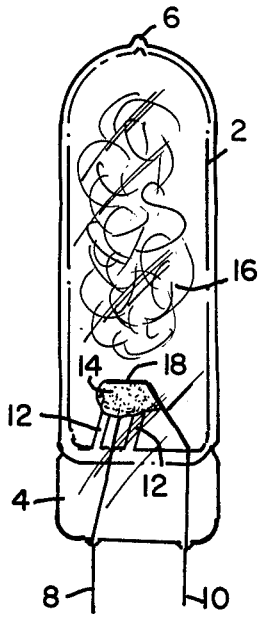
FIG. 1 is an elevational view of a photoflash lamp in accordance with the invention.
Figure 2:
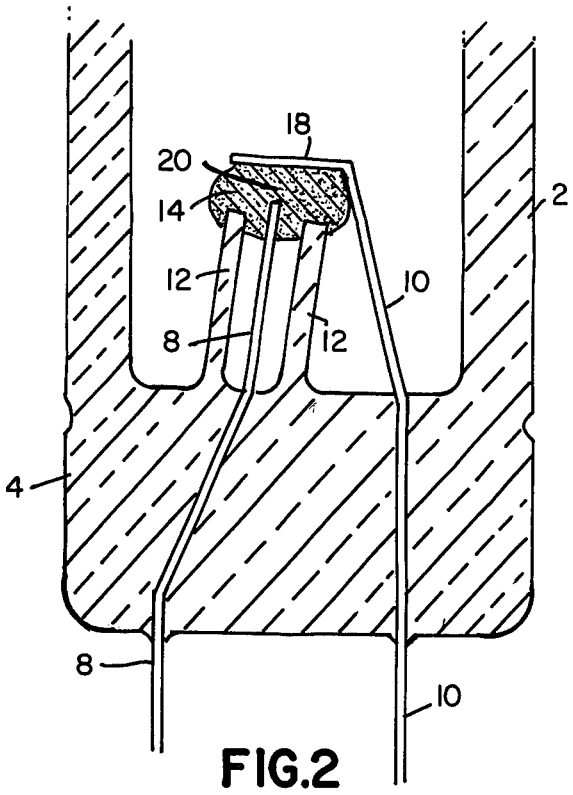
FIG. 2 is a fragmentary vertical sectional view on an enlarged scale of the inlead and ignition means construction of the lamp of FIG. 1.

Referring to FIGS. 1 and 2, the high-voltage type flashlamp illustrated therein comprises an hermetically sealed light-transmitting envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press, an insulating sleeve 12 extending within the envelope about lead-in wire 8, and a mass of primer material 14 bridging the end portions of the lead in wires within the envelope. The insulating sleeve 12 may be formed of glass or ceramic and is preferably sealed into the envelope press 4 at one end so that only the inward end of the sleeve is open. It will be noted that the sleeve 12 has no side vent hole.

In accordance with the invention, lead-in wire 8 extends beyond the open end of sleeve 12, and lead-in wire 10 is formed at an angle to provide a terminating portion 18 which overlies and is spaced from the open end of sleeve 12 to provide a predetermined gap 20 between terminating portion 18 and the end of lead-in wire 8. The mass of primer material 14 is applied so as to cover the open end of sleeve 12 so that the gap 20 between the lead-in wires is enclosed and reliably bridged.

Typically, the lamp envelope 2 has an internal diameter of less than one-half inch and an internal volume of less than 1 cc. A quantity of filamentary combustible fill material 16, such as shredded zirconium or hafnium foil, is disposed within the lamp envelope. The envelope 2 is also provided with a filling of combustion-supporting gas such as oxygen, at a pressure of several atmospheres. Typically, the exterior surface of the glass envelope 2 is also provided with a protective lacquer coating, such a cellulose acetate (not shown).

Conceivably, gap 20 could be a fixed value lying in the range of about 0.002 to 0.080 inch. Tests indicate good results using a gap dimension in the range of 0.015 to 0.030 inch. The ideal gap appears to be 0.020 inch. The lower gap range of 0.002 to 0.010 inch could possibly cause primer breakdown without primer ignition due to head loss through the lead-in wires. The upper gap range of 0.040 to 0.080 inch could provide difficulty in maintaining the proper primer bridge necessary for lamp flashing and protection from shred shorts.

The end of lead-in wire 8 extends, or protrudes, beyond the open end of sleeve 12 approximately 0.010 inch, although this distance may range from about 0.005 to 0.015 inch.

Operation of such high voltage type flashlamps is initiated when a high voltage pulse from, e.g., a piezoelectric crystal, is applied across the two lead-in wires 8 and 10. Electrical breakdown of the primer causes its deflagration which, in turn, ignites the shredded metallic combustible 16.

The advantages of the improved ignition structure design described include: a definite primer bridge between the inner portions of the lead-in wires; protection of the sleeved lead-in wire 8 from shorting with filamentary combustible 16; control of the primer quantity and the voltage breakdown using a specified gap 20 between the sleeved lead-in wire 8 and the terminating portion 18 of lead-in wire 10; and a more positive ignition of the filamentary combustible material 16 by the primer 14.

Referring to FIG. 2, it is very evident that the lead-in wire 8 in the glass sleeve makes primer bridging between lead-in wires more positive. Since the sleeved lead-in wire 8 is extended above the sleeve 12, primer flows around the lead to provide a completed circuit path.

Another advantage of the described ignition structure design is the protection of the sleeved lead-in wire 8 from fill shorts. The lead-in wire 8 positioned above the sleeve tends to maintain a fixed amount of primer coating over the sleeved lead-in wire, and also acts as a buffer when the shredded metal 16 is blown into the lamp.

Primer quantity control can also be attained with this mount structure. The distance from the sleeved lead-in wire 8 to the free lead-in wire 10 controls the amount of primer 14 to be applied. Just as important is a reliable means of controlling the voltage breakdown of the primer. The proposed mount design has a very distinct advantage in this respect since the circuit path is a controlled distance. Also, the circuit path contains a sufficient amount of primer for proper breakdown.

It is conceivable that with one of the prior art constructions, the actual quantity of primer available for metal shred ignition is limited due to the primer being blown into the glass sleeve. The present ignition structure maintains sufficient primer at the top of the sleeve to reliably ignite the metal shreds.

Figure 3:
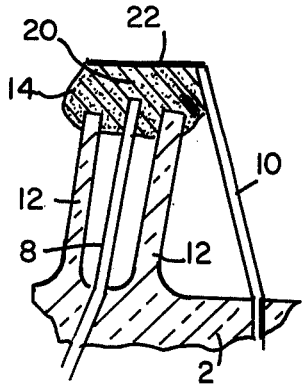
FIG. 3 is a fragmentary vertical sectional view of an enlarged scale of an alternative inlead and ignition means construction.
Figure 4:
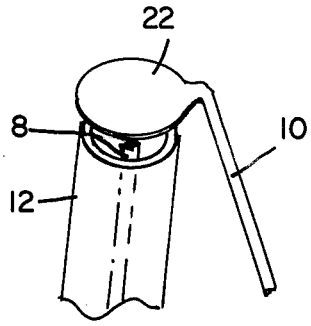
FIG. 4 is a perspective view of a portion of the FIG. 3 construction.

An alternate construction is illustrated in FIGS. 3 and 4 wherein, instead of using the normal lead-in wire diameter, the terminating portion of lead-in wire 10 is flattened, as denoted by the numeral 22, to provide better coverage for the sleeved lead 8. The width dimension of flat portion 22 can range from slightly greater than the diameter of the lead-in wire 10 up to the diameter of sleeve 12. A preferred range for production use is from about 0.025 to 0.035 inch.

By way of example only, a group of 507 lamps of the construction shown in FIGS. 1 and 2 were prepared. The lamps were fabricated from type 7052 glass tubing of 0.259" O.D. The internal volume was 0.35 $cm^3$; the quantity of filamentary combustible material 16 was 13 mgs. of 4"- long zirconium shreds having a cross section of 0.00093" × 0.0012"; the oxygen fill pressure was 1150 cm. Hg. absolute. The lead-in wires 8 and 10 were 0.012" diameter Rodar; the insulating sleeve 12 was 0.160" long, type 7052 glass having an O.D. of 0.073" and an I.D. of 0.027". The gap 20 between the lead wires was about 0.020 inch and wire 8 protruded beyond the open end of sleeve 12 by about 0.010 inch. Approximately 2 mgs. of primer 14 were used for each lamp. The lamps were flashed from a piezoelectric source having a 60 microjoule, 2,000 volt output pulse. All lamps flashed reliably. Test results indicate a more uniform voltage breakdown than the prior art construction.

Although the invention has been described with respect to a specific embodiment, it will be appreciated that modifications and changes may be made by those skilled in the art without departing from the true spirit and scope of the invention.

What we claim is:

1. A photoflash lamp comprising:

an hermetically sealed, light-transmitting envelope;

a quantity of filamentary combustible material located within said envelope;

a combustion-supporting gas in said envelope;

an ignition means disposed in said envelope in operative relationship with respect to said combustible fill material, said ignition means including first and second lead-in wires extending into said envelope in a spaced relationship, a sleeve of insulating material extending within said envelope about said first lead-in wire, said sleeve being sealed to said envelope at one end and open at the other end of said sleeve, said first lead-in wire extending beyond the open end of said sleeve, said second lead-in wire having an integral terminating portion formed from said wire at an angle therefrom and entirely disposed substantially in a plane which overlies and is spaced from the open end of said sleeve to provide a predetermined gap between said terminating portion and the end of said first lead-in wire extended beyond said sleeve, and a mass of primer material disposed to cover the open end of said sleeve and bridge said gap.

2. The lamp of claim 1 wherein the terminating portion of said second lead-in wire is flattened to have a width in a range greater than the diameter of said wire and less than the diameter of said sleeve.

3. The lamp of claim 2 wherein the width of said terminating portion is in a range of about 0.025 to 0.035 inch.

4. The lamp of claim 1 wherein said gap is in a range of about 0.002 to 0.080 inch.

5. The lamp of claim 5 wherein said gap is in a range of about 0.015 to 0.030 inch.

6. The lamp of claim 1 wherein the end of said first lead-in wire extends beyond the open end of said sleeve by a distance in the range of about 0.005 to 0.015 inch.

* * * * *